US011718331B2

(12) United States Patent
Ye et al.

(10) Patent No.: US 11,718,331 B2
(45) Date of Patent: Aug. 8, 2023

(54) NON-NATIONAL STANDARD TURNOUT DRIVE SYSTEM BASED ON DOUBLE 2-VOTE-2 ARCHITECTURE

(71) Applicant: CASCO SIGNAL CO., LTD., Shanghai (CN)

(72) Inventors: Ruiyuan Ye, Shanghai (CN); Ting Jiang, Shanghai (CN); Xinxin Li, Shanghai (CN); Liang Chen, Shanghai (CN); Weijuan Li, Shanghai (CN); Zenghua Fang, Shanghai (CN); Xiaonan Liu, Shanghai (CN); Man Xu, Shanghai (CN)

(73) Assignee: CASCO SIGNAL CO., LTD., Shanghai (CN)

( * ) Notice: Subject to any disclaimer, the term of this patent is extended or adjusted under 35 U.S.C. 154(b) by 475 days.

(21) Appl. No.: 16/767,556

(22) PCT Filed: Oct. 31, 2018

(86) PCT No.: PCT/CN2018/112832
§ 371 (c)(1),
(2) Date: May 27, 2020

(87) PCT Pub. No.: WO2019/100916
PCT Pub. Date: May 31, 2019

(65) Prior Publication Data

US 2021/0171075 A1 Jun. 10, 2021

(30) Foreign Application Priority Data

Nov. 27, 2017 (CN) ..... 201711206189.X

(51) Int. Cl.
*B61L 5/06* (2006.01)
*E01B 7/00* (2006.01)
(Continued)

(52) U.S. Cl.
CPC ..... *B61L 5/062* (2013.01); *B61L 5/06* (2013.01); *B61L 19/06* (2013.01); *B61L 27/30* (2022.01); *B61L 27/33* (2022.01); *E01B 7/00* (2013.01)

(58) Field of Classification Search
CPC .. B61L 5/06; B61L 5/062; B61L 19/06; B61L 27/30; B61L 27/33; E01B 7/00
See application file for complete search history.

(56) References Cited

U.S. PATENT DOCUMENTS 8,668,170 B2 * 3/2014 Lostun ..... B61L 27/33 701/19
9,096,245 B2 * 8/2015 Lostun ..... B61L 27/33
(Continued)

FOREIGN PATENT DOCUMENTS

CN 201376578 Y 1/2010
CN 104816740 A * 8/2015
(Continued)

OTHER PUBLICATIONS

International Search Report and Written Opinion issued in PCT/CN2018/112832, dated Jan. 30, 2019, in English and Chinese, 18 pages provided.

*Primary Examiner* — Zachary L Kuhfuss
(74) *Attorney, Agent, or Firm* — Hamre, Schumann, Mueller & Larson, P.C.

(57) ABSTRACT

The disclosure relates to a non-national standard turnout drive system based on a double 2-vote-2 architecture, including an interlocking processing subsystem IPS, an interlocking maintenance station SDM, a non-national standard turnout drive module HIOM and an interlocking maintenance station SDM, wherein the non-national standard turnout drive module HIOM, a full-electronic communication module EIOCOM2, and the interlocking processing subsystem IPS are connected with each other in order, and
(Continued)

the full-electronic communication module EIOCOM2 is connected to the interlocking maintenance station SDM; two non-national standard turnout drive module HIOMs, which are mutually redundant, obtain turnout drive commands through the interlocking processing subsystem IPS to control drive relays in a non-national standard turnout to lift and fall for driving the turnout to rotate toward a specified direction, while collecting representation information of the turnout and determining a position of the turnout. Compared with the prior art, the disclosure has advantages of high reliability and strong maintainability.

8 Claims, 5 Drawing Sheets

(51) Int. Cl.

| | |
|---|---|
| ***B61L 27/30*** | (2022.01) |
| ***B61L 19/06*** | (2006.01) |
| ***B61L 27/33*** | (2022.01) |

(56) References Cited

U.S. PATENT DOCUMENTS

| | | | | |
|---|---|---|---|---|
| 10,332,708 | B2 * | 6/2019 | Kanner | H01H 47/002 |
| 2008/0183306 | A1 * | 7/2008 | Ashraf | B61L 29/22 246/125 |
| 2012/0325981 | A1 * | 12/2012 | Lostun | B61L 27/33 246/219 |
| 2014/0138495 | A1 * | 5/2014 | Lostun | B61L 5/1881 246/219 |

FOREIGN PATENT DOCUMENTS

| | | | | |
|---|---|---|---|---|
| CN | 104890701 | A | 9/2015 | |
| CN | 106444553 | A | 2/2017 | |
| CN | 106740991 | A | 5/2017 | |
| CN | 106740992 | A | 5/2017 | |
| CN | 107933613 | A | 4/2018 | |
| DE | 19819162 | A1 * | 1/1999 | B61L 5/062 |
| WO | 2011067121 | A1 | 6/2011 | |

* cited by examiner

NON-NATIONAL STANDARD TURNOUT DRIVE SYSTEM BASED ON DOUBLE 2-VOTE-2 ARCHITECTURE

TECHNICAL FIELD

The disclosure relates to the field of railway signal device, in particular, to a non-national standard turnout drive system based on a double 2-vote-2 architecture.

BACKGROUND

In order to achieve the correct driving of non-national standard turnouts and collect representation information of non-national standard turnouts, more complex relay circuits and monitoring circuits are required to build, which leads more relays and monitoring circuits required in actual design and construction. These relays and monitoring circuits are costly and take up a lot of space in the machine room. In addition, when a relay fails, an alarm can not be sent in time, which is inconvenient for field maintenance.

After retrieval, a Chinese patent publication number CN201376578Y discloses a turnout drive system, including external devices, a power supply module 1, a power supply module 2, a power supply module 3, a turnout start circuit, a turnout representation circuit, turnout fixed and inversible manipulation modules, a turnout start circuit drive power output module and a switch power module, wherein the power supply module 1, the switch power module, the turnout start circuit drive power output module, the turnout start circuit, and the external devices are connected with each other in order; the power supply module 2 is connected to the turnout start circuit and the external devices respectively, the power supply module 3 is connected to the external devices through the turnout representation circuit, and the turnout fixed and inversible manipulation modules are connected to the turnout start circuit respectively. In the utility model, some coil relays of the turnout drive system are replaced with electronic circuit modules, which greatly reduce the maintenance workload, thereby fundamentally solving the problem that the turnout may malfunction due to the mixed wires. However, the utility model still uses more complicated electronic circuits and various modules, which is costly and takes up a lot of space, and the utility model can only support a switch of single type.

SUMMARY

An object of the disclosure is to provide a non-national standard turnout drive system based on a double 2-vote-2 architecture so as to overcome the above defects in prior art.

The purpose of the disclosure may be realized by the following technical solutions.

A non-national standard turnout drive system based on a double 2-vote-2 architecture includes an interlocking processing subsystem (IPS) an interlocking maintenance station, a non-national standard turnout drive module and an interlocking maintenance station, wherein the non-national standard turnout drive module, a full-electronic communication module, and the interlocking processing subsystem (IPS) are connected with each other in order, and the full-electronic communication module is connected to the interlocking maintenance station;

two non-national standard turnout drive modules, which are mutually redundant, obtain turnout drive commands through the interlocking processing subsystem (IPS) to control drive relays in a non-national standard turnout to lift and fall for driving the turnout to rotate toward a specified direction, while collecting representation information of the turnout and determining a position of the turnout.

Preferably, the interlocking processing subsystem (IPS), the full-electronic communication module and the non-national standard turnout drive module are all double 2-vote-2 systems.

Preferably, the non-national standard turnout drive module is provided with a drive module driven by the non-national standard turnout, a representation collection module for the non-national standard turnout to represent information collection, and a self-test module periodically checking safety devices on its own module.

Preferably, the non-national standard turnout drive module includes a field programmable gate array (FPGA) and a central processing unit (CPU) that are connected with each other in order;

the non-national standard turnout drive module further includes a turnout metering voltage collection module connected to the FPGA, and the CPU is connected to the full-electronic communication module;

two FPGAs periodically collect a turnout metering voltage through the turnout metering voltage collection module, and transmit to two CPUs respectively; two CPUs determines a representation status through the metering voltage, then results in a final representation status by comparison with double 2-vote-2, and transmit the representation status to the interlocking maintenance station through the full-electronic communication module.

Preferably, both the FPGA and the CPU utilize dual hot-backup redundancy.

Preferably, the non-national standard turnout drive module further includes a non-national standard turnout drive current collection module connected to the FPGA, the drive current collection module periodically collects a drive current of the non-national standard turnout and then transmits to the CPU through the FPGA, and the CPU sends the drive current information to the interlocking processing subsystem (IPS) and the interlocking maintenance station through the full-electronic communication module respectively.

Preferably, the interlocking maintenance station has functions of saving received monitoring information and alarming malfunction.

Preferably, the non-national standard turnout drive module further includes a power supply module, a relay control module and an isolation module; when an exception occurs in the power supply module or the relay control module, the isolation module disconnects power from a relay.

Preferably, the non-national standard turnout drive module further includes a fuse module; when the isolation module fails or an exception affecting safety occurs in a drive system, the fuse module may blow a fuse and guide the drive system to a safe status.

Preferably, by changing external wiring, types of non-national standard turnout switch supported by the drive system including:

a three-phase three-wire turnout switch, with a drive voltage of an alternative current of 380V, driven in three-wire mode, having a representation signal of a direct current of 0-48V;

a three-phase five-wire turnout switch, with a drive voltage of an alternative current of 380V, driven in five-wire mode, having a representation signal of a direct current of 0-48V;

a single-phase six-wire turnout switch, with a drive voltage of an alternative current of 220V, driven in six-wire mode, having a representation signal of a direct current of 0-48V;

and a single-phase three-wire turnout switch, with a drive voltage of an alternative current of 220V, driven in three-wire mode, having a representation signal of a direct current of 0-48V.

Compared with the prior art, the present disclosure has the following advantages:

1. This system is based on 2-vote-2 architecture and BIT technique, ensuring safety; a high-performance CPU, an FPGA and small relays are used to replace the previous relay circuit method, which reduces difficulty in construction and project costs; and the redundancy design of 2-vote-2 supports hot-plugging, which may greatly improve system reliability and maintainability.

2. The system may replace the previous relay circuits and monitoring circuits with lower cost, simpler construction, and easier maintenance; the turnout drive module may drive non-national standard turnouts and collect turnout representation information according to the commands sent by the IPS. Further, the turnout drive module may alarm malfunction and save monitoring information through the interlocking maintenance station.

3. The system may support switches of different types by changing external wiring, which is versatile as compared with traditional turnout drive system that may only support a switch of a single type.

DETAILED DESCRIPTION OF EMBODIMENTS

The technical solutions in the embodiments of the present disclosure will be clearly and completely described hereafter. It is apparent that the described embodiments are a part of the embodiments of the present disclosure, but not the whole. Based on the embodiments of the present disclosure, all the other embodiments obtained by those of ordinary skill in the art without inventive effort are within the scope of the present disclosure.

Figure 1:
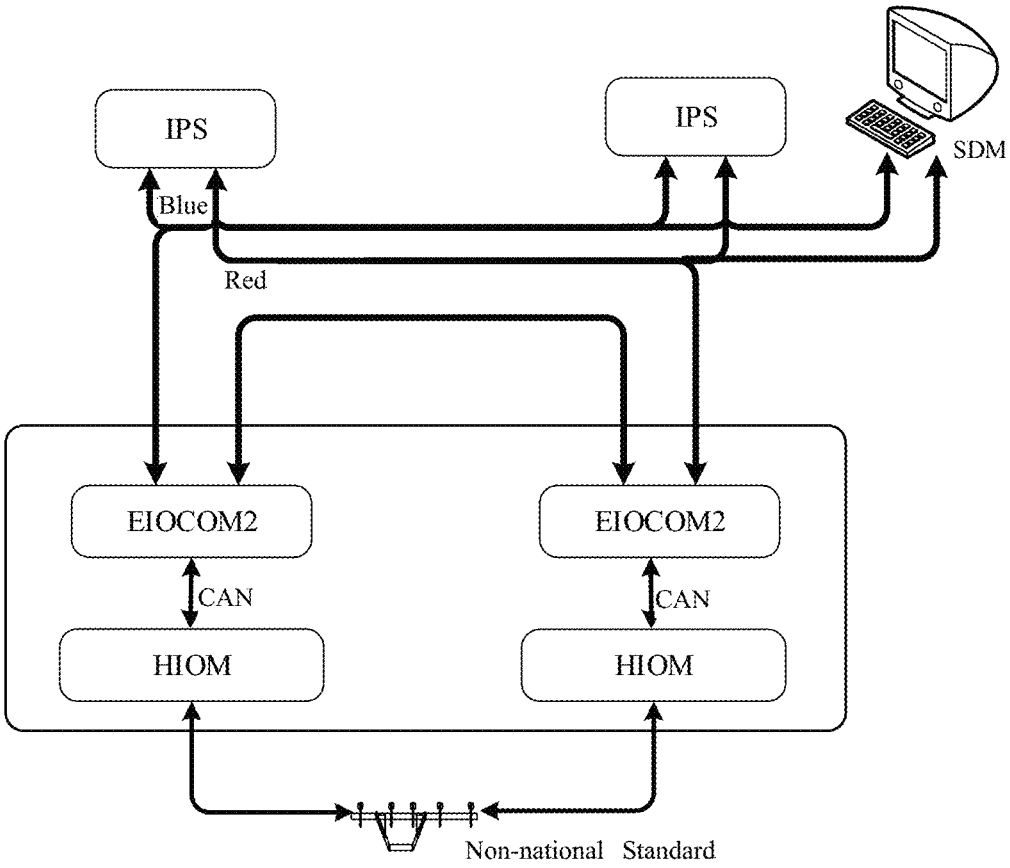
FIG. 1 is a view showing a structure of a non-national standard turnout drive system according to the disclosure.

As shown in FIG. 1, a non-national standard turnout drive system based on a double 2-vote-2 architecture replaces the previous relay circuits with high performance circuit boards, which reduces difficulty in construction and maintenance costs. The system includes an interlocking processing subsystem IPS, an interlocking maintenance station SDM, a non-national standard turnout drive module HIOM, and a full-electronic communication module EIOCOM2. The non-national standard turnout drive module HIOM obtains turnout drive commands from the interlocking processing subsystem IPS through the full-electronic communication module EIOCOM2, drives the non-national standard turnout for fixed operation or inversible operation according to the received commands, and collects turnout representation information after the turnout completes operation, while sending board maintenance information to the interlocking maintenance station SDM. This system is based on 2-vote-2 architecture and BIT technique, ensuring safety; a high-performance CPU, an FPGA and small relays are used to replace the previous relay circuit method, which reduces difficulty in construction and project costs; and the redundancy design of 2-vote-2 supports hot-plugging, which may greatly improve system reliability and maintainability. The interlocking processing subsystem IPS, the interlocking maintenance station SDM, and the non-national standard turnout drive module HIOM are all self-developed systems.

The non-national standard turnout drive module HIOM supports one set of turnouts. Two non-national standard turnout drive modules HIOM, which are mutually redundant, work in parallel at the same time, wherein if any one fails, it does not affect the other module. At the same time, the board supports hot-plugging to improve maintainability.

The interlocking processing subsystem IPS, the full-electronic communication module EIOCOM2 and the non-national standard turnout drive module HIOM all are dual hot-backup systems (i.e., a double 2-vote-2 architecture), wherein the full-electronic communication module EIOCOM2 and the non-national standard turnout drive module HIOM support hot-plugging. Compared with the previous relay circuit, the difficulty in construction and device footprint are greatly reduced, which saves costs from engineering and hardware.

In terms of software, the interlocking processing subsystem IPS maintains existing softwares, and the interlocking maintenance station SDM adds an interface with the full-electronic communication module EIOCOM2, while the non-national standard turnout drive module HIOM is newly self-developed. The non-national standard turnout drive module HIOM has software functions divided into 5 subtasks: a mode management task, a fuse unit task, an isolation unit task, a drive unit task, and a representation collection task. The mode management task is mainly used to determine the current mode of the software; the fuse unit task is used to periodically detect the fuse module and perform safe state processing in the event of an exception in the non-national standard turnout drive module HIOM; the isolation unit task is mainly used to detect the isolation unit, and handle the isolation state when an exception occurs in the power supply module and an output unit of the non-national standard turnout drive module HIOM, including in the relay control module; the drive unit task is mainly used to obtain the turnout drive commands and drive the non-national standard switch, periodically check statuses of the power supply module and the relay control module, and uploads the drive current information and alarming information to the interlocking maintenance station SDM for monitoring; the presentation collection task is mainly used to collect information about a position where the turnout is located, and send the collected turnout representation information to the IPS, while periodically checking a status of the turnout representation collection module.

Figure 2:
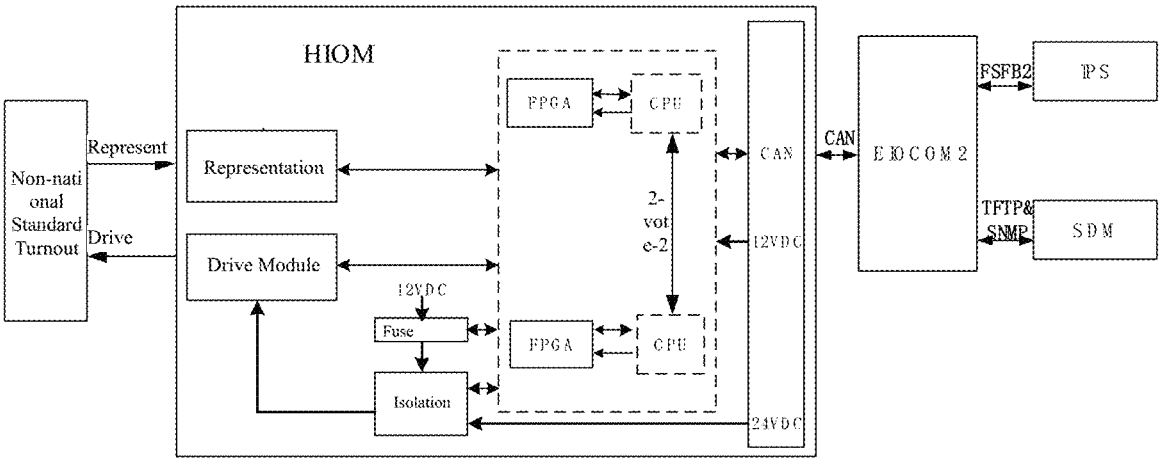
FIG. 2 is an internal schematic view of a non-national standard turnout drive module HIOM according to the disclosure.

As shown in FIG. 2, the non-national standard turnout drive module HIOM supports the driving of the non-national standard turnout and collection of current representation information; the CPU controls the relay control unit to drive the relay to lift and fall through the FPGA according to the non-national standard turnout drive commands received from the interlocking processing subsystem IPS. The FPGA may periodically read back the status of the relay and transmit to the CPU. Meanwhile, the CPU may switch working modes (self-test mode and collection mode) of the representation module through the FPGA. The representation collection module periodically collects the representation information of the turnout, and sends the information to the CPU through the FPGA. The non-national standard turnout drive module HIOM sends information such as the drive module, the drive current and the turnout representation information to the SDM.

Figure 3:
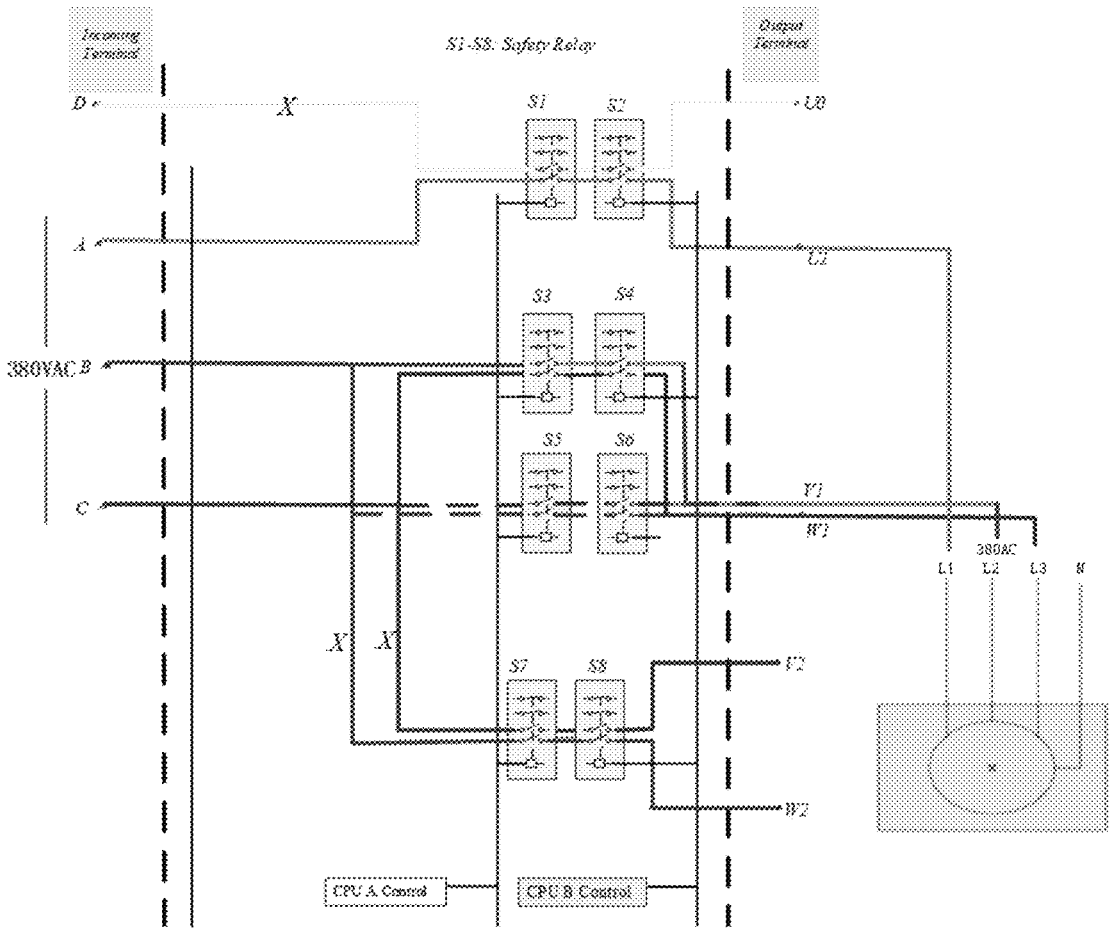
FIG. 3 is a view showing a connection between a non-national standard turnout drive module HIOM and a three-phase three-wire turnout switch according to the disclosure.

As shown in FIG. 3, the non-national standard turnout drive module HIOM may drive and collect a three-phase three-wire turnout switch. A, B and C are input terminals of three-phase alternative current, and D input is null; U1, V1 and W1 are output terminals of three-phase alternative current connected to the three-phase three-wire turnout switch, and U0 output is null. The incoming wires of B and C phases are separated in the board, outputting four wires. U1 is connected to a motor L1, and V1 and W1 are connected to L2 and L3 respectively. Each of the incoming wires utilizes two safety relays of 2-open-2-close type as its output relays. S7 and S8 are not used in the application of three-phase three-wire turnout, and maintain a state where normally-opened contacts are open.

Figure 4:
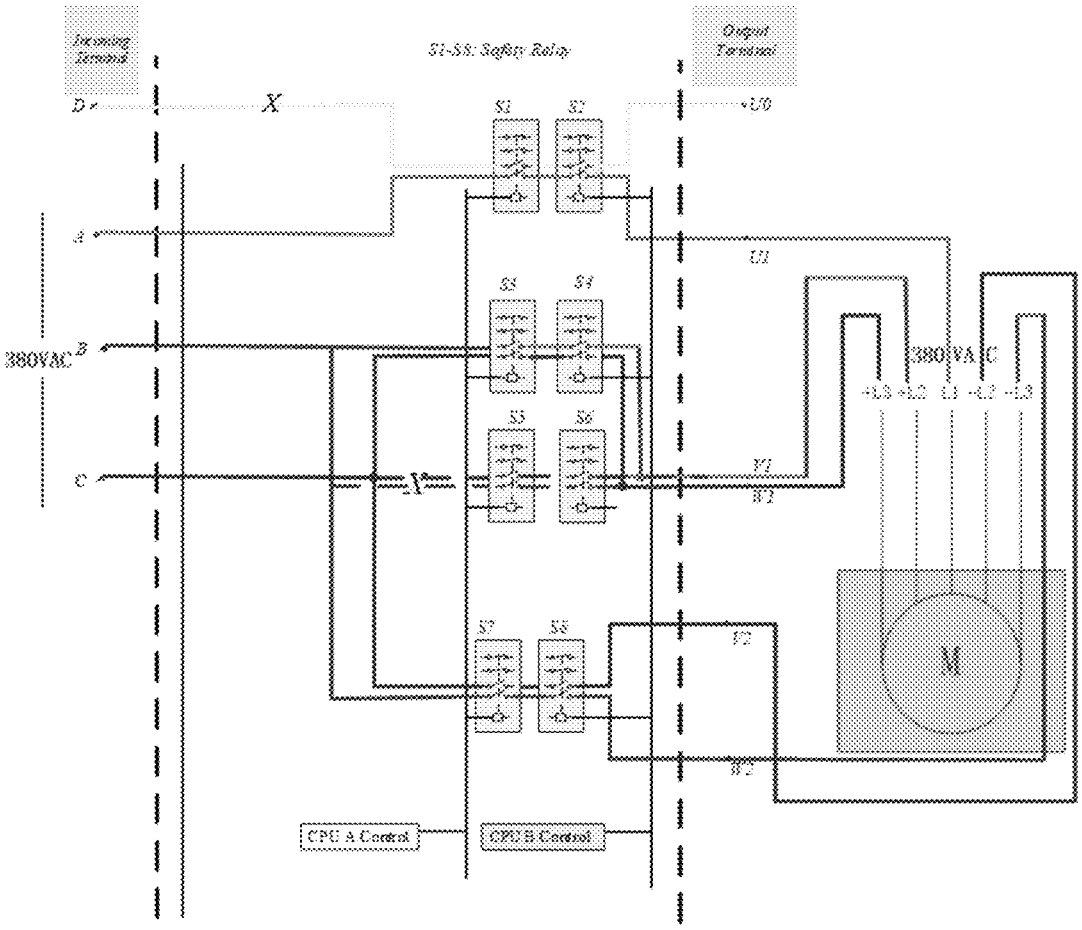
FIG. 4 is a view showing a connection between a non-national standard turnout drive module HIOM and a three-phase five-wire turnout switch according to the disclosure.

As shown in FIG. 4, the non-national standard turnout drive module HIOM may drive and collect a three-phase five-wire turnout switch. A, B and C are input terminals of three-phase alternative current, and D input is null. U1, V1, W1, V2 and W2 are output terminals connected to the three-phase five-wire turnout switch, and U0 terminal is null. The incoming wires of B and C phases are separated in the board, outputting four wires. U1, V1 and W1 are connected to L1, +L2 and +L3 of the motor respectively to control the motor to rotate forward. U1, V2 and W2 are connected to L1, −L2 and −L3 of the motor respectively to control the motor to rotate rearward. Each of the output lines utilizes two safety relays of 2-open-2-close type as its output relays. S5 and S6 are not used in the application of three-phase five-wire turnout, and maintain a state where normally-opened contacts are open.

Figure 5:
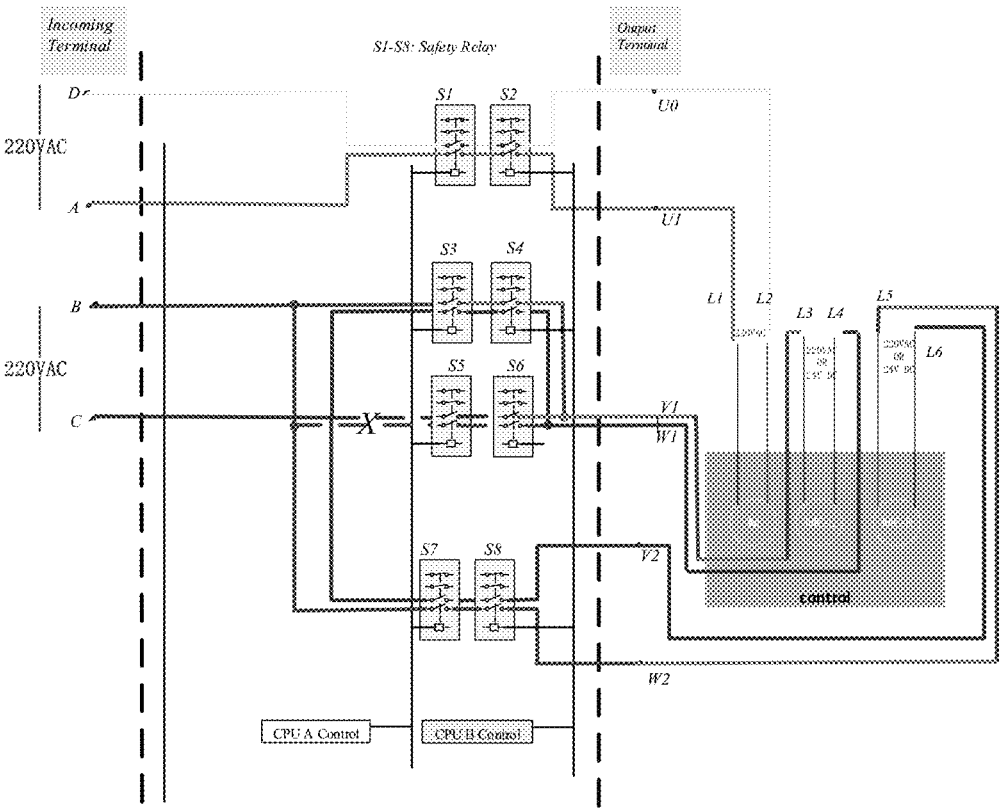
FIG. 5 is a view showing a connection between a non-national standard turnout drive module HIOM and a single-phase six-wire turnout switch according to the disclosure.

As shown in FIG. 5, the non-national standard turnout drive module HIOM may drive and collect a single-phase six-wire turnout switch, wherein A and D inputs are sources of one input with corresponding outputs of U0 and U1, and B and C inputs are one source; the incoming wires of B and C terminals are separated in the board, outputting four wires, with corresponding outputs of V1, W1 and V2, W2. U0 and U1 are connected to power drives L1 and L2 of the single-phase six-wire turnout switch for power drive. V1 and W1 is connected to L3 and L4 that control fixed operation direction, V2 and W2 are connected to L5 and L6 that control inversible operation direction, and V1, W1, and V2, W2 are used to control the rotation direction. Each of the output lines utilizes two safety relays of 2-open-2-close type as its output relays. S5 and S6 are not used in the application of single-phase six-wire turnout switch, and maintain a state where normally-opened contacts are open.

Figure 6:
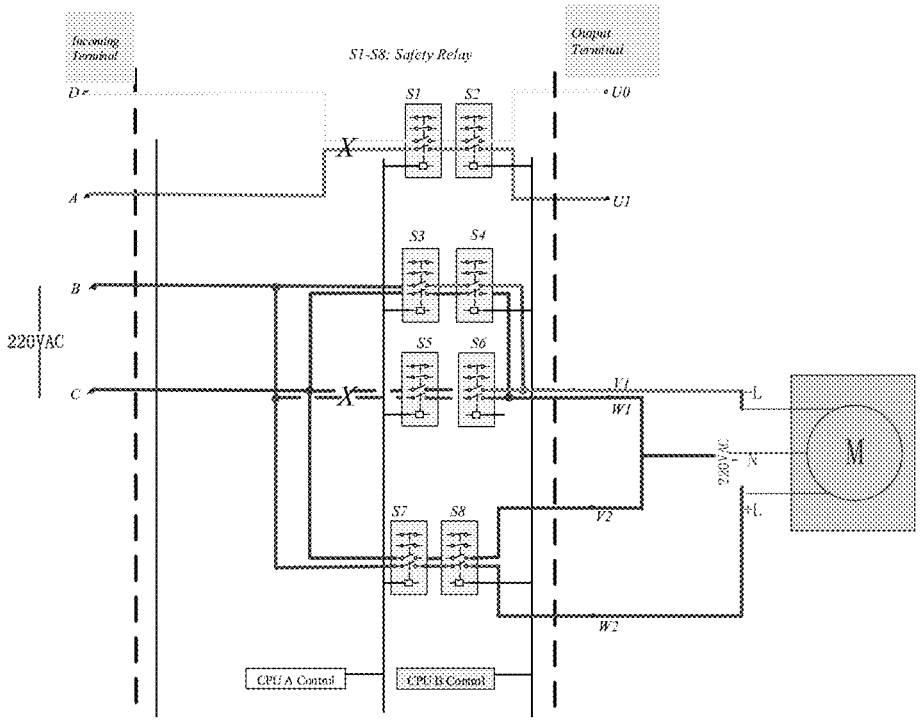
FIG. 6 is a view showing a connection between a non-national standard turnout drive module HIOM and a single-phase three-wire turnout switch according to the disclosure.

As shown in FIG. 6, the non-national standard turnout drive module HIOM may drive and collect a single-phase three-wire turnout switch, wherein B and C serve as unique input source; the incoming wires of B and C terminals are separated in the board, outputting four wires, with corresponding outputs of V1, W1 and V2, W2. Among them, W1 and V2 are connected in parallel to N phase of the single-phase three-wire turnout switch, V1 is connected to +L, and W2 is connected to −L. Each of the output lines utilizes two safety relays of 2-open-2-close type as its output relays. S1, S2, S5 and S6 are not used in the application of single-phase three-wire turnout switch, and maintain a state where normally-opened contacts are open.

Figure 7:
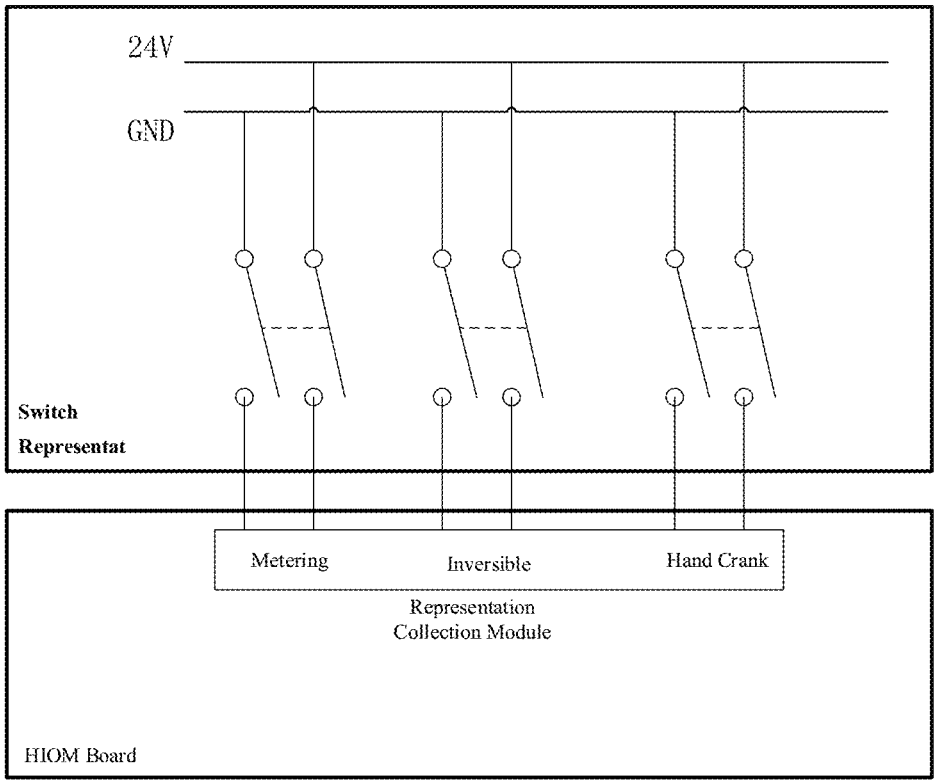
FIG. 7 is a view showing a connection between a non-national standard turnout drive module HIOM and a representation module of a non-national standard turnout switch according to the disclosure.

As shown in FIG. 7, three ports of the representation collection module of the non-national standard turnout drive module HIOM collect representation information output from the non-national standard turnout switch such as metering, inversible metering and hand crank. The non-national standard turnout switch has a representation signal of a direct current level signal of 0 to 48V, which is generally 24V.

What is mentioned above is only the specific implementation of the present disclosure, but does not limit the protection scope of the present disclosure, and anyone skilled in the art may easily think of mortifications and alternations within the technical scope disclosed by the present disclosure, all of which should be contained within the protection scope of the present disclosure. Therefore, the scope of the present disclosure should be determined by the scope of the claims.

The invention claimed is:

1. A turnout drive system based on a double 2-vote-2 architecture, comprising an interlocking processing subsystem (IPS), an interlocking maintenance station, a turnout drive module and an interlocking maintenance station, wherein the turnout drive module, a full-electronic communication module, and the interlocking processing subsystem (IPS) are connected with each other in order, and the full-electronic communication module is connected to the interlocking maintenance station;

two turnout drive modules, which are mutually redundant, obtain turnout drive commands through the interlocking processing subsystem (IPS) to control drive relays in a turnout to lift and fall for driving the turnout to rotate toward a specified direction, while collecting representation information of the turnout and determining a position of the turnout, wherein the turnout drive module further comprises a power supply module, a relay control module and an isolation module; when an exception occurs in the power supply module or the relay control module, the isolation module disconnects power from a relay, and wherein the turnout drive module further comprises a fuse module; when the isolation module fails or an exception affecting safety occurs in a drive system, the fuse module may blow a fuse and guide the drive system to a safe status.

2. The turnout drive system based on a double 2-vote-2 architecture according to claim 1, wherein the interlocking processing subsystem (IPS), the full-electronic communication module and the turnout drive module are all double 2-vote-2 systems.

3. The turnout drive system based on a double 2-vote-2 architecture according to claim 1, wherein the turnout drive module is provided with a drive module driven by the turnout, a representation collection module for the turnout to represent information collection, and a self-test module periodically checking safety devices on its own module.

4. The turnout drive system based on a double 2-vote-2 architecture according to claim 1, wherein the turnout drive module comprises a field programmable gate array (FPGA) and a central processing unit (CPU) that are connected with each other in order;

the turnout drive module further comprises a turnout metering voltage collection module connected to the FPGA, and the CPU is connected to the full-electronic communication module;

two FPGAs periodically collect a turnout metering voltage through the turnout metering voltage collection module, and transmit to two CPUs respectively; two CPUs determines a representation status through the metering voltage, then results in a final representation status by comparison with double 2-vote-2, and transmit the representation status to the interlocking maintenance station through the full-electronic communication module.

5. The turnout drive system based on a double 2-vote-2 architecture according to claim 4, wherein both the FPGA and the CPU utilize dual hot-backup redundancy.

6. The turnout drive system based on a double 2-vote-2 architecture according to claim 5, wherein the turnout drive module further comprises a turnout drive current collection module connected to the FPGA, the drive current collection module periodically collects a drive current of the turnout and then transmits to the CPU through the FPGA, and the CPU sends the drive current information to the interlocking processing subsystem (IPS) and the interlocking maintenance station through the full-electronic communication module respectively.

7. The turnout drive system based on a double 2-vote-2 architecture according to claim 1, wherein the interlocking maintenance station has functions of saving received monitoring information and alarming malfunction.

8. A turnout drive system based on a double 2-vote-2 architecture, comprising an interlocking processing subsystem (IPS), an interlocking maintenance station, a turnout drive module and an interlocking maintenance station, wherein the turnout drive module, a full-electronic communication module, and the interlocking processing subsystem (IPS) are connected with each other in order, and the full-electronic communication module is connected to the interlocking maintenance station;

two turnout drive modules, which are mutually redundant, obtain turnout drive commands through the interlocking processing subsystem (IPS) to control drive relays in a turnout to lift and fall for driving the turnout to rotate toward a specified direction, while collecting representation information of the turnout and determining a position of the turnout, wherein by changing external wiring, types of turnout switch supported by the drive system comprising:

a three-phase three-wire turnout switch, with a drive voltage of an alternative current of 380V, driven in three-wire mode, having a representation signal of a direct current of 0-48V;

a three-phase five-wire turnout switch, with a drive voltage of an alternative current of 380V, driven in five-wire mode, having a representation signal of a direct current of 0-48V;

a single-phase six-wire turnout switch, with a drive voltage of an alternative current of 220V, driven in six-wire mode, having a representation signal of a direct current of 0-48V; and a single-phase three-wire turnout switch, with a drive voltage of an alternative current of 220V, driven in three-wire mode, having a representation signal of a direct current of 0-48V.

* * * * *